US009429367B2

(12) United States Patent
Jouanny et al.

(10) Patent No.: US 9,429,367 B2
(45) Date of Patent: Aug. 30, 2016

(54) AUTOMOBILE CONDENSER HAVING ENHANCED INTEGRATION

(75) Inventors: Philippe Jouanny, Guyancourt (FR); Carlos Martins, Le Chesnay (FR); Anne-Sylvie Magnier-Cathenod, Saint-Cloud (FR)

(73) Assignee: VALEO SYSTEMS THERMIQUES, Le Mesnil Saint Denis (FR)

( * ) Notice: Subject to any disclaimer, the term of this patent is extended or adjusted under 35 U.S.C. 154(b) by 1062 days.

(21) Appl. No.: 13/499,224

(22) PCT Filed: Sep. 28, 2010

(86) PCT No.: PCT/EP2010/064358
§ 371 (c)(1),
(2), (4) Date: Jun. 8, 2012

(87) PCT Pub. No.: WO2011/039186
PCT Pub. Date: Apr. 7, 2011

(65) Prior Publication Data

US 2012/0234523 A1 Sep. 20, 2012

(30) Foreign Application Priority Data

Sep. 30, 2009 (FR) ..... 09 04668

(51) Int. Cl.
*F28D 9/00* (2006.01)
*F28F 9/02* (2006.01)
*F28D 21/00* (2006.01)

(52) U.S. Cl.
CPC ..... *F28D 9/005* (2013.01); *F28D 9/0093* (2013.01); *F28F 9/0246* (2013.01); *F28D 2021/0084* (2013.01); *F28F 2250/06* (2013.01)

(58) Field of Classification Search
CPC .... F28D 9/0037; F28D 9/005; F28D 9/0093; F28D 2021/0084; F28F 3/083; F28F 9/0246; F28F 2250/06
USPC ..... 165/166, 167, 140
See application file for complete search history.

(56) References Cited

U.S. PATENT DOCUMENTS 4,274,482 A 6/1981 Sonoda
4,815,534 A * 3/1989 Fuerschbach ..... 165/167
(Continued)

FOREIGN PATENT DOCUMENTS

DE 19519740 A1 12/1996
FR 2843449 A1 2/2004
(Continued)

OTHER PUBLICATIONS

Jeffus, Larry, Back to the Basics of Brazing and Soldering, Mar. 6, 2006, the News.*
(Continued)

*Primary Examiner* — Tho V Duong
*Assistant Examiner* — Raheena Rehman
(74) *Attorney, Agent, or Firm* — Howard & Howard Attorneys PLLC

(57) ABSTRACT

The invention relates to a condenser (10, 20) to be used in an air-conditioning circuit of an automobile, including punched plates (20) stacked in a longitudinal direction and defining first blades for the circulation of a first fluid as well as second blades for the circulation of a second fluid, said second blades being interleaved with the first blades, said condenser enabling the alternating circulation of the first fluid. According to the invention, said condenser includes inlet tubing (28) for the first fluid and outlet tubing (30) for the first fluid provided on a single first end surface (24) of said stack.

16 Claims, 4 Drawing Sheets

(56) References Cited

U.S. PATENT DOCUMENTS

Figure 1:
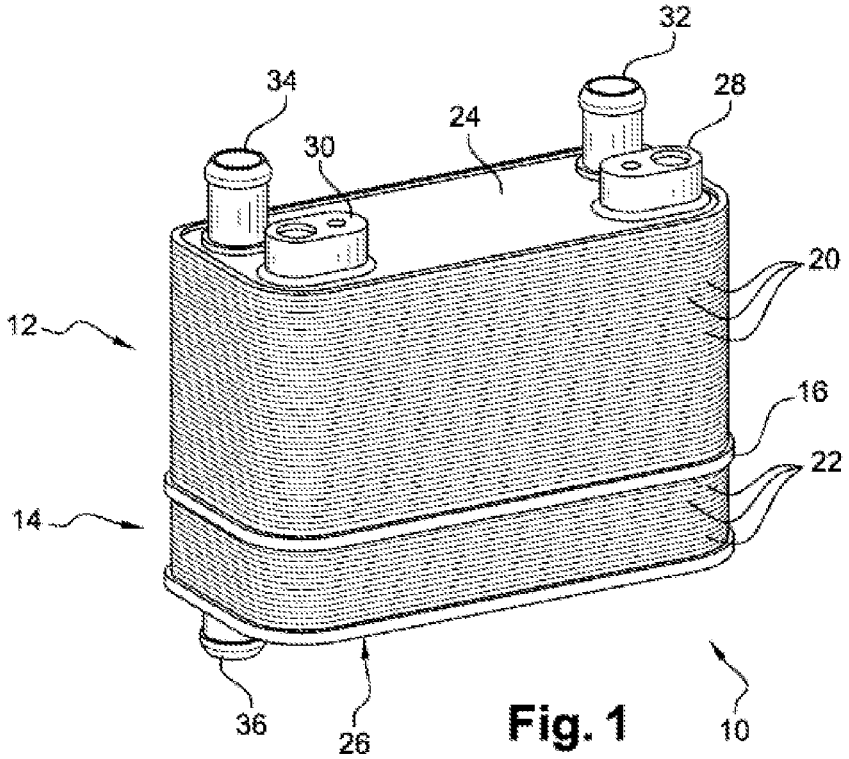

| | | | | |
|---|---|---|---|---|
| 5,435,383 | A * | 7/1995 | Rajagopal | 165/167 |
| 5,964,283 | A | 10/1999 | Pavlin | |
| 6,026,894 | A * | 2/2000 | Bachinger | 165/166 |
| 6,935,417 | B1 * | 8/2005 | Inoue et al. | 165/167 |
| 8,122,736 | B2 | 2/2012 | Martins et al. | |
| 2001/0054499 | A1 * | 12/2001 | Gerard et al. | 165/166 |
| 2004/0112579 | A1 * | 6/2004 | Strahle | 165/166 |
| 2004/0144525 | A1 * | 7/2004 | Chatel et al. | 165/166 |
| 2005/0194123 | A1 * | 9/2005 | Strahle et al. | 165/167 |
| 2006/0053833 | A1 * | 3/2006 | Martins et al. | 62/507 |
| 2010/0258285 | A1 * | 10/2010 | Yao et al. | 165/167 |

FOREIGN PATENT DOCUMENTS

| | | | |
|---|---|---|---|
| FR | 2846733 | A1 | 5/2004 |
| FR | 2846736 | A1 | 5/2004 |
| FR | 2870588 | A1 | 11/2005 |
| FR | 2924490 | A1 | 6/2009 |
| WO | WO 2004017006 | A2 * | 2/2004 |
| WO | WO 2005124255 | A1 * | 12/2005 |

OTHER PUBLICATIONS

See English language abstract for DE 19519740 extracted from the espacenet.com database on May 23, 2012, 8 pages.

See English language abstract and translation for FR 2843449 extracted from the espacenet.com database on May 23, 2012, 34 pages.

See English language abstract for FR 2846733 extracted from the espacenet.com database on May 23, 2012, 34 pages.

See English language abstract and translation for FR 2846736 extracted from the espacenet.com database on May 23, 2012, 34 pages.

See English language abstract and translation for FR 2870588 extracted from the espacenet.com database on May 22, 2012, 25 pages.

See English language abstract and translation for FR 2924490 extracted from the espacenet.com database on May 23, 2012, 36 pages.

International Search Report for Application No. PCT/EP2010/064358 dated Oct. 27, 2010, 7 pages.

* cited by examiner

10

AUTOMOBILE CONDENSER HAVING ENHANCED INTEGRATION

RELATED APPLICATIONS

This application claims priority to and all the advantages of International Patent Application No. PCT/EP2010/064358, filed on Sep. 28, 2010, which claims priority to French Patent Application No. FR 09/04668, filed on Sep. 30, 2009.

The invention relates to the field of air conditioning circuits, in particular for motor vehicles.

It concerns more specifically a condenser, to be used in such a circuit, comprising punched plates stacked in a longitudinal direction and defining first blades intended for the circulation of a first fluid as well as second blades intended for the circulation of a second fluid, the said second blades being interleaved with the said first blades; two first collectors formed by the alignment in the longitudinal direction and the placing in fluid communication of inlet and outlet orifices belonging respectively to the blades intended for the first fluid, a first of the said first collectors, known as the inlet collector for the first fluid, comprising at least two connection lines, the other of the said first collectors, known as the outlet collector for the first fluid, comprising at least two other connection lines; a first inlet pipe stub intended for the first fluid discharging into one connection line, referred to as upstream, of the said connection lines of the inlet collector for the first fluid; a first outlet pipe stub intended for the first fluid discharging into a connection line, referred to as downstream, of the said connection lines of the outlet collector for the first fluid, the said connection lines of the inlet collector and the said connection lines of the outlet collector for the first fluid being arranged to permit the alternating circulation of the first fluid from the inlet collector towards the outlet collector, from the upstream connection line towards the downstream connection line.

A condenser of this type is already known, in particular from FR 2 846 733.

Condensers of this type must be mounted in the interior of the vehicle and connected to the circuits of the first and second fluids. The size and the connection possibilities of these condensers are especially critical for the integration of the condensers into the vehicle. In addition, ready accessibility to the connection between the condenser and the rest of the circuits is sought in order to facilitate assembly and subsequent maintenance operations.

Because currently known condensers have proven to be only partially satisfactory, the applicant has adopted the aim of improving the situation.

The proposed condenser is a condenser as defined by way of introduction comprising an outlet line placing the said downstream connection line in communication with the said outlet pipe stub in such a way that the first inlet pipe stub and the first outlet pipe stub are provided on the same first end surface of the said stack.

Thus, the inlets and outlets for the first fluid, including when this concerns the refrigerant fluid passing through the condenser, are on the same side of the exchanger. This facilitates integration in the motor vehicle and improves accessibility to the connections of the condenser in question.

In the configuration of the condenser according to the invention, the said upstream connection line is close to the said first end surface, whereas the said downstream connection line is remote from it.

The condenser additionally comprises, for example, two second collectors formed by the alignment in the longitudinal direction and the placing in fluid communication of inlet and outlet orifices belonging respectively to the blades intended for the second fluid.

According to one embodiment, the said first collectors are mutually juxtaposed in the lateral direction and/or the said second collectors are mutually juxtaposed in the lateral direction.

The first inlet pipe stub and/or the first outlet pipe stub are able to pass through the said first end surface.

The said condenser comprises, for example, blanking plates for the inlet and/or outlet orifices belonging to the blades intended for the first fluid, each being a blanking plate defining two connection lines in the first respective connector. At least one of the blanking plates is also adapted to be passed through by the outlet line.

For this purpose, the said blanking plate is provided, for example, with an orifice having a form corresponding to the cross section of the outlet line, at least in the vicinity of the said blanking plate, and with a sealing means arranged externally between the outlet line and the blanking plate. The sealing means comprise, in particular, a solder deposit.

According to one embodiment, the outlet line passes successively through the inlet and/or outlet orifices of each blade forming a connection line adjacent to the downstream connection line in the outlet collector for the first fluid.

The outlet line is also able to pass through the inlet and/or outlet orifices of each blade forming each connection line arranged longitudinally between the first end surface and the downstream connection line in the outlet collector for the first fluid.

According to one particular embodiment, a first part of the said stack defines the second blades interleaved with a part of the said first blades, whereas a second part of the stack defines third blades intended for the circulation of a third fluid, the said third blades being interleaved with the other part of the said first blades, the said downstream connection line belonging to the second part of the said stack.

According to this embodiment, the condenser additionally comprises, for example, two third collectors that are mutually juxtaposed in the lateral direction and are formed by the alignment in the longitudinal direction and the placing in fluid communication of inlet and outlet orifices belonging respectively to the blades intended for the second fluid, the said third collectors being defined in their entirety by at least two connection lines; a third inlet pipe stub and a third outlet pipe stub intended for the third fluid.

The third inlet pipe stub and the third outlet pipe stub pass through, in particular, a second end surface of the said stack, the said second surface being longitudinally opposite the said first end surface.

The third inlet pipe stub and the third outlet pipe stub can be in fluid communication respectively with the third collectors.

The said first and second parts of the said stack are, for example, separated from one another by an intermediate separation plate. The latter consists of, in particular, a first orifice adapted to be passed through by the outlet pipe stub. It can also be adapted to block the inlet and outlet orifices belonging to the blades intended for the second fluid that are remote from the said first end surface.

According to one particular embodiment, the separation plate is provided with supplementary orifices calibrated to place the second collectors and the third collectors respectively in fluid communication, the second and the third fluids then being the same and the condenser exhibiting a single inlet pipe stub and a single outlet pipe stub for the said same fluid.

Figure 2:
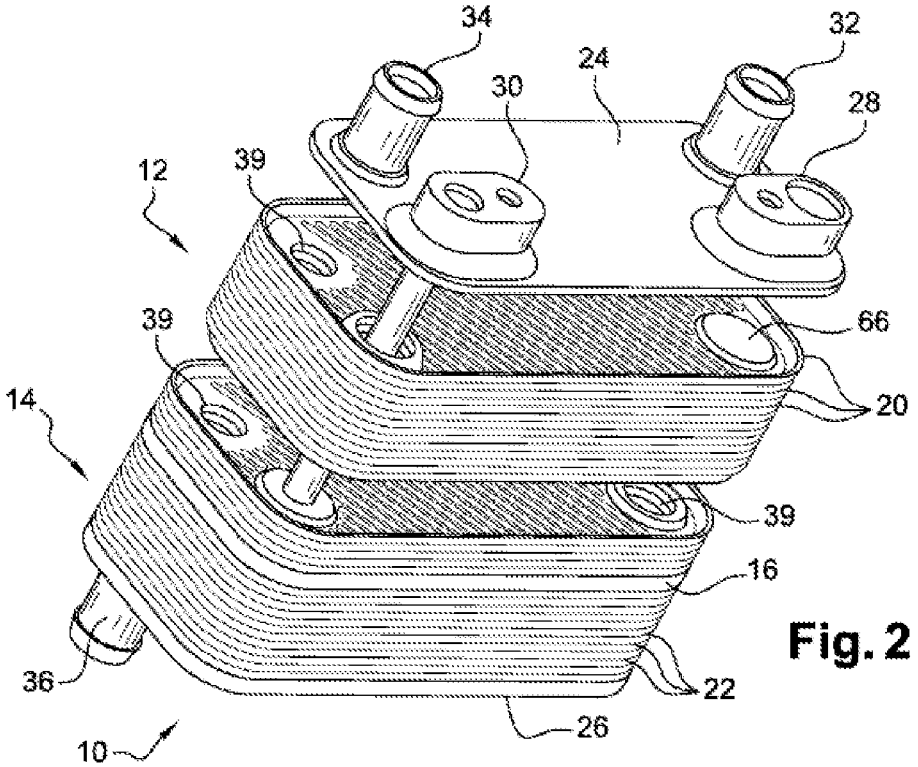
Figure 3:
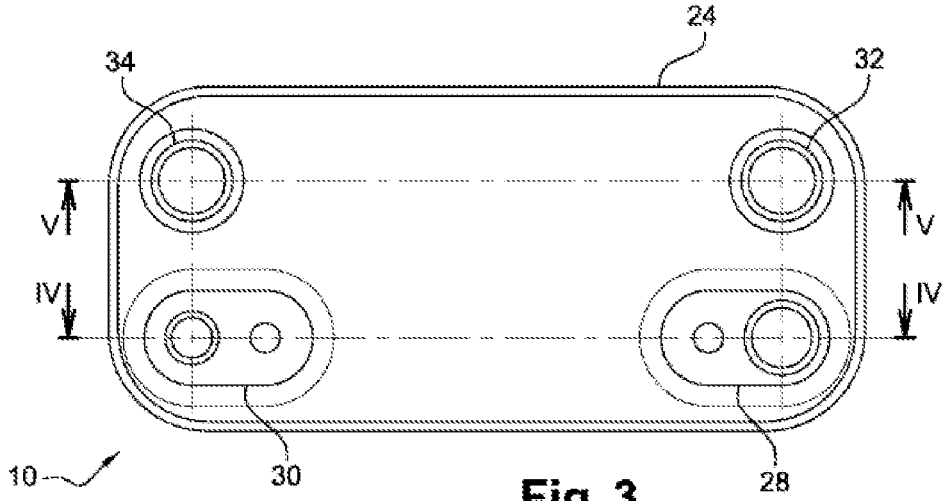
Figure 4:
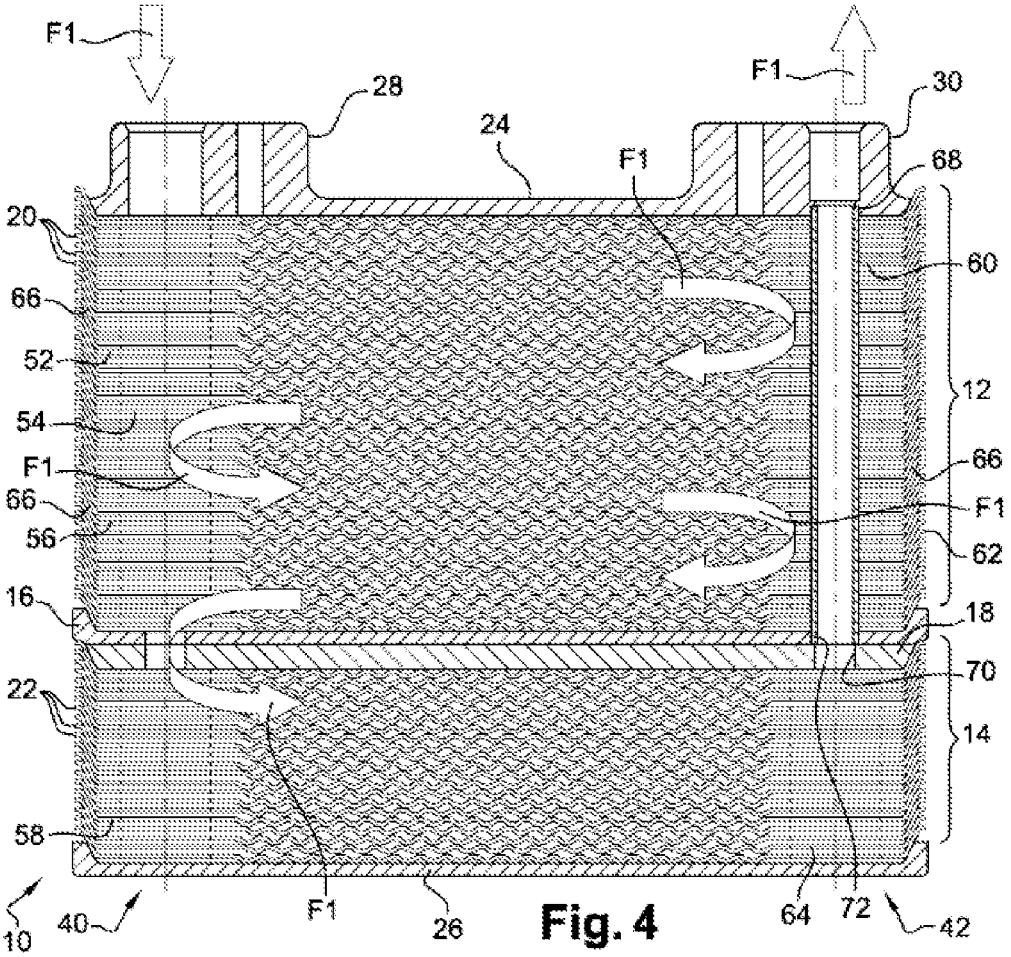
Figure 5:
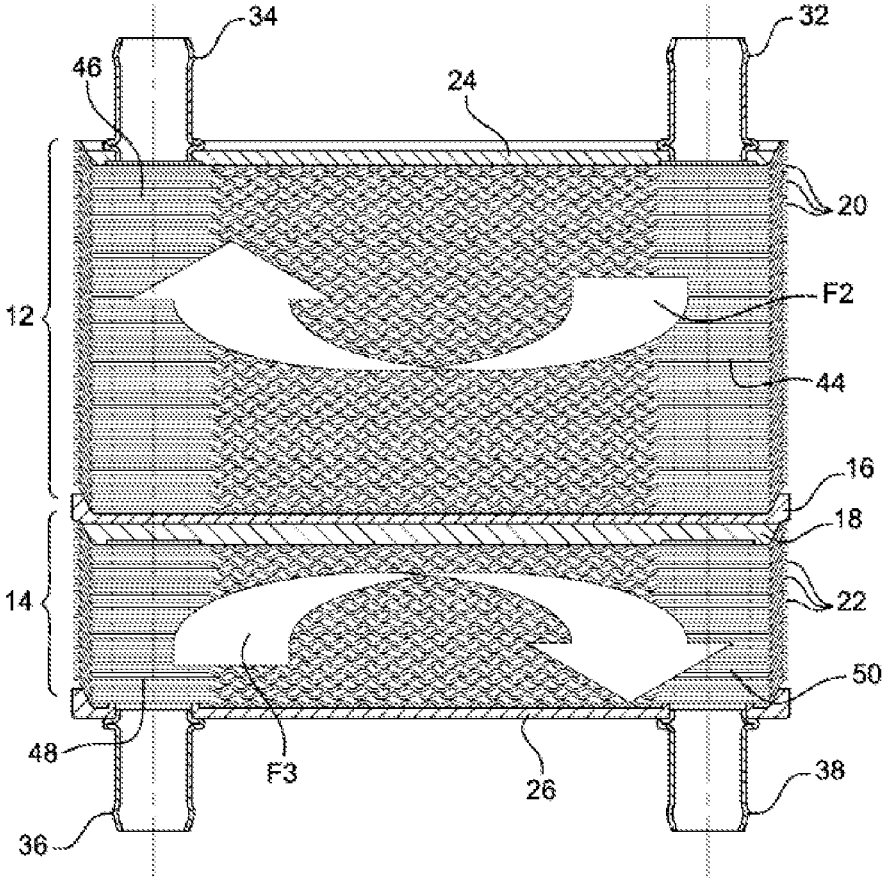
Figure 6:
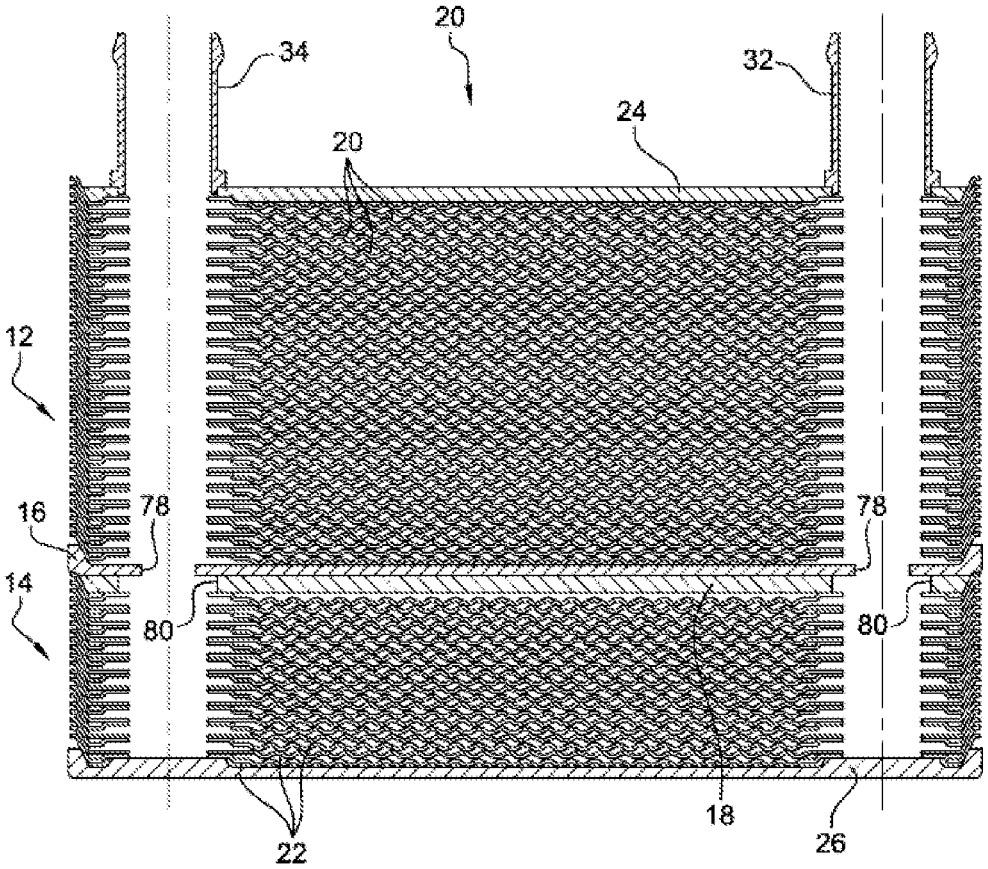

Other characteristics and advantages of the invention will become apparent from an examination of the following detailed description and the accompanying drawings, in which:

FIG. 1 illustrates a first embodiment of a condenser according to the invention, viewed in isometric perspective, FIG. 2 illustrates the condenser in FIG. 1 viewed in exploded isometric perspective, certain of the plates having been omitted, FIG. 3 illustrates the condenser in FIG. 1 viewed in plan and from above, FIG. 4 is a view of the condenser in FIG. 1 viewed in cross section according to the line IV-IV in FIG. 3, FIG. 5 illustrates the condenser in FIG. 1 viewed in cross section according to the line V-V in FIG. 3, and FIG. 6 illustrates a second embodiment of a condenser in a view similar to that in FIG. 5.

The drawings comprise, in the main, elements of a certain character. Nevertheless, they can be used not only to facilitate understanding of the description, but also to contribute to its definition, should this be necessary.

FIGS. 1 to 5 illustrate a condenser 10 intended to be part of an air conditioning circuit, not depicted here, in particular for a motor vehicle.

In such a circuit, a refrigerant fluid, or a first fluid, passes in a closed loop through a compressor, the aforementioned condenser, a pressure reducer and an evaporator, before returning to the compressor, and so on.

Here, the condenser 10 is intended to function with a refrigerant fluid that is capable of being present both in liquid form and in gaseous form, for example a fluorinated fluid such as that known as R134a.

The condenser 10 comprises a first heat exchange block 12 to ensure the cooling of the refrigerant fluid until its point of condensation by means of a first cooling fluid.

This cooling fluid may consist of water with the addition of an antifreeze agent, for example of the glycol type.

The condenser 10 also comprises a second heat exchange block 14 to ensure sub-cooling of the refrigerant fluid by means of a second cooling fluid.

The second cooling fluid may also be constituted by water with the addition of an antifreeze agent. In particular, the second cooling fluid and the first cooling fluid may together form one and the same fluid circulating in one and the same circuit.

The condenser 10 may also comprise a bottle, not depicted here, disposed between the first block 12 and the second block 14 and suitable to be passed through by the refrigerant fluid.

The refrigerant fluid in the gaseous phase, as it arrives from the compressor, is initially cooled until its point of condensation in the first block 12. If necessary, this refrigerant fluid passes through the bottle, where it is filtered and dehydrated. The condensed refrigerant fluid then passes through the second block 14, which ensures its sub-cooling.

The condenser 10 also comprises a first sole plate 16 and a second sole plate 18, both of which sole plates are interleaved between the first block 12 and the second block 14. The first sole plate 16 and the second sole plate 18 form interfaces for the circulation of refrigerant fluid between this first block 12 and this second block 14.

In a variant embodiment, not depicted here, the condenser comprises a specific plate of similar form to the other plates of the first and the second block, but exhibiting only two orifices, the said specific plate separating the said blocks while at the same time permitting, through its said two orifices, communication of the refrigerant fluid between the two blocks.

The first block 12 comprises a series of punched plates 20 stacked in one longitudinal direction of the condenser 10. In this case, the punched plates 20 exhibit the general form of a rectangular bowl. The punched plates 20 of the first block 12 define circulation blades for the refrigerant fluid, which alternate with circulation blades for the first cooling fluid. In other words, these punched plates 20 define first blades intended for the circulation of the refrigerant fluid and second blades intended for the circulation of the first cooling fluid, the said second blades being interleaved with the said first blades.

The second block 14 also comprises a series of punched plates 22 stacked in the longitudinal direction of the condenser 10. In this case, the punched plates 22 exhibit a general appearance similar to that of the punched plates 20. These punched plates 22 form circulation blades for the refrigerant fluid, which alternate with circulation blades for the second cooling fluid. In other words, these punched plates 22 define third blades intended for the circulation of the second refrigerant fluid, the said third blades being interleaved in a part of the said first blades.

In other words, the stack of punched plates 20 and 22 comprises a first part corresponding to the first heat exchange block 12, which defines second blades interleaved in a first part of the said first blades, whereas the other part of this stack of plates defines third blades interleaved in the other part of the said first blades.

The punched plates 20 of the first block 12 are maintained between the first sole plate 16 and a first end plate 24, longitudinally opposite the first sole plate 16. The punched plates 22 of the second block 14 are contained between the second sole plate 18 and a second end plate 26, longitudinally opposite the second sole plate 18.

The first end plate 24 carries a coupling flange 28 for the inlet of the refrigerant fluid for condensation and a coupling flange 30 for the outlet of this condensed and sub-cooled refrigerant fluid. In FIG. 4, the circulation of this refrigerant fluid inside the condenser 10 is illustrated by arrows F1.

The first cooling fluid penetrates into the first block 12 via an inlet pipe stub 32 and exits from it via an outlet pipe stub 34, both supported by the first end plate 24. In FIG. 5 The circulation of the first cooling fluid is represented by an arrow F2.

The second cooling fluid penetrates into the second block 14 via an inlet pipe stub 36 and exits from it via an outlet pipe stub 38, both supported by the second end plate 26. In FIG. 5, the circulation of the second cooling fluid is represented by an arrow F3.

The first and the second cooling fluid can be one and the same fluid taken at different points from the same circuit, or different fluids in the sense that they exhibit different compositions and/or belong to different circuits.

Each of the punched plates 20 of the first block 12 exhibits four circular orifices 39, for example situated in the vicinity of each corner of the plate provided in substantially rectangular form. Each of the orifices of the same punched plate 20 belongs to an alignment, in the longitudinal direction, of the equivalent orifices of the group of punched plates 20 of the first block 12.

In the same way, each of the punched plates 22 of the second block 14 is pierced by four circular orifices. Two of these orifices belong respectively to two alignments of equivalent orifices in the punched plates 22 of this block 14, whereas the other two orifices belong to two respective alignments of the first heat exchange block 12.

In a particular manner, each orifice of a punched plate 22 of the second block 14 is in alignment here, in the longitudinal direction with an alignment of equivalent orifices of punched plates 20 in the first block 12.

The alignment of these latter orifices forms two first collectors 40 and 42, mutually juxtaposed in the lateral direction, formed by the alignment, in the longitudinal direction, and the placing in fluid communication of inlet and outlet orifices belonging respectively to the blades intended for the refrigerant fluid.

These first two collectors 40 and 42 are formed by orifices belonging to punched plates 20 of the first block 12 and orifices arranged in the punched plates 22 of the second heat exchange block 14. Two second collectors mutually juxtaposed in the lateral direction, formed by the alignment in the longitudinal direction and the placing in fluid communication of inlet and outlet orifices belonging respectively to the blades intended for the first cooling fluid, are also formed. These second collectors are formed by the alignment of orifices belonging to punched plates 20 of the first block 12 only.

Two third collectors, mutually juxtaposed in the lateral direction, formed by the alignment in the longitudinal direction and the placing in fluid communication of inlet and outlet orifices belonging respectively to the blades intended for the second cooling fluid, are also formed. These third collectors are formed by the alignment of orifices arranged in punched plates 22 of the second heat exchange block 14 only.

The first collectors 40 and 42 in their entirety are defined as a plurality of connection lines.

Thus, the first inlet collector 40, attached to the inlet coupling flange 28, is partitioned into four connection lines 52, 54, 56 and 58, adjacent one to the other, whereas the first outlet collector 42, attached to the outlet coupling flange 30, is partitioned into three connection lines 60, 62 and 64.

The coupling flange 28 for the inlet of refrigerant fluid discharges into the connection line 52 of the first inlet collector 40. The connection line 52 thus forms an upstream connection line, close to the first end plate 24. From there, the refrigerant fluid circulates within a part of the punched plates 20 in order to reach the connection line 60 of the first outlet collector 42. From there, the refrigerant fluid passes laterally through the condenser 10 in order to reach the connection line 54 of the first inlet collector 40, then the connection line 62 of the first outlet collector 42, then the connection line 56 of the first inlet collector 40, adjacent to the connection line 54 according to an alternating circulation of the first inlet collector towards the first outlet collector.

The connection line 58 of the first inlet collector 40 is formed by the alignment of the orifices of each of the punched plates 22 of the second heat exchange block 14.

The first sole plate 16 and the second sole plate 18 are pierced respectively by a passageway, the two passageways coinciding one with the other to permit the passage of the refrigerant fluid from the connection line 56, of the first block 12, to the connection line 58 of the second block 14.

From there, the refrigerant fluid reaches the connection line 64, which thus forms a downstream line that is remote from the first end surface 24.

The connection line 64 of the second block 14 is separated from the adjacent connection line 62 by the first sole plate 16 and the second sole plate 18. These first and second 18 sole plates in this case are in mutual support over the largest part of their surface.

The rest of the connection lines 52, 54, 56, 60 and 62 are partitioned one in relation to the other by blocking the corresponding orifice of a punched plate 20 of the first block 12, for example by means of a flat plug 66 that is visible in FIG. 2.

An outlet line 68 connects the outlet coupling flange 30 in fluid connection with an orifice 70 arranged in the second sole plate and discharging into the connection line 64 of the second block 14. Here, the extremity of the inlet pipe stub 68, close to the second block 14 is received in an adapted bore 72 provided in the first sole plate 16.

The refrigerant fluid passes from the connection line 64 to the coupling flange 30 through the intermediary of the outlet line 68 in order to exit from the condenser 10.

The outlet line 68 thus passes through a part of the first outlet collector 40, specifically the connection lines 60 and 62.

In other words, the outlet pipe stub 68 passes through the equivalent orifices of each of the punched plates 20 of the block 12.

The flat plug 66 ensuring the separation of the connection line 60 from the connection line 66 is pierced by a conformed hole corresponding to the peripheral contour of the outlet line 68 at this level.

A soldering operation ensures sealing between the external wall of the outlet line 68 and the said flat plug 66, by creating a deposit of solder there.

In general terms, the connecting line 68 passes through the first outlet collector 42, being coaxial with it, the said connecting line 68 providing an annular passage for the circulation of the said first fluid in the one or more said connecting lines 60, 62 that are present above the downstream connecting line 64.

The first cooling fluid penetrates into the first block 12 via the inlet pipe stub 32 and reaches the second inlet collector 44.

From there, the cooling fluid passes through the condenser 10 through the intermediary of the blades that are intended for it and arrives at the second outlet collector 46 for exit via the pipe stub 34.

One or more additional passes by this cooling liquid could be provided in a manner similar to that described above.

The second cooling fluid enters the second block 14 via the pipe stub 36 and thus discharges into the third inlet collector 48. This cooling fluid reaches the outlet collector 50 through the intermediary of the blades that are intended for it and exits via the pipe stub 38.

One or more additional passes could be provided in this case, too.

FIG. 6 illustrates a second condenser 20 as a variant of the condenser 10. The condenser 20 differs from the condenser 10 in that the same cooling fluid is utilized in the first heat exchange block 12 and the second heat exchange block 14 as the first cooling fluid and the second cooling fluid respectively.

In this embodiment, the second end plate 50 is devoid of an inlet pipe stub 36 and an outlet pipe stub 38. The first sole plate 16 and the second sole plate 18 are provided with calibrated orifices 78 and 80, in correspondence with the third inlet collector 48 and the third outlet collector 50, in order to provide a passage for the cooling fluid from the first heat exchange block 12 to the second heat exchange block 14.

In another variant embodiment, an inlet pipe stub is provided for the second and third fluids on each of the blocks, whereas a single outlet pipe stub is provided for the said second and third fluids, the condenser permitting a mixture of the said second and third fluids in one of the said second or third outlet collector, pre-disposed for connection to the said single outlet pipe stub. In this variant, the one or more sole plates or separation plates between the two blocks are pierced with an orifice to permit the said second and third outlet collectors to be brought into communication, the said second and third inlet collectors being kept separate by the said one or more sole plates or separation plates.

All the connections of the condenser 20 to the rest of a fluid circuit are arranged on a same end surface of this condenser 20, namely the first end plate 24.

As a supplement or in addition, the second block 14 could be replaced by or completed with an internal heat exchanger, that is to say a heat exchanger in which the same fluid circulates in the two types of blades under different conditions of temperature and pressure.

The stack of punched plates 22 of the second block 14 can then be oriented in the opposite way in relation to the punched plates 20 of the first block 12.

Here, the punched plates 20 of the first block 12 and those 22 of the second block 14 are configured in a similar manner and are stacked in such a way as to be oriented in an alternating fashion in relation to one another. This permits a condenser 10 to be produced at a lower cost and facilitates its assembly. For all that, the plates 20 of the first block 12 and those 22 of the second block 14 could differ from one another in their form, in the material utilized for their realization, or in other ways.

In a similar manner, the stacking pitch of the punched plates 20 of the first block 12 and that of the plates 22 of the second block 14 may differ from one another.

Although the first sole plate 16 and the second sole plate 18 are shown bearing against one another, they may also be remote from one another, in particular if it is necessary to interleave a circuit element between the first block 12 and the second block 14.

The invention is not restricted to the embodiments described above, which are provided solely by way of example, but includes all the variants that could be envisaged by a person skilled in the art.

The invention claimed is:

1. A condenser (10, 20) to be used in an air conditioning circuit of an automobile, the condenser comprising:

punched plates (20) stacked in a longitudinal direction and defining first blades intended for the circulation of a first fluid as well as second blades intended for the circulation of a second fluid, the second blades being interleaved with the first blades, a first heat exchange block (12) and a second heat exchange block (14) formed by the plates;

a first separation plate (16) and a second separation plate (18) disposed between the first heat exchange block (12) and the second heat exchange block (14)

two first collectors (40, 42) in the second heat exchange block (14), formed by alignment in the longitudinal direction and the placing in fluid communication of inlet and outlet orifices (39) belonging respectively to the blades intended for the first fluid, a first (40) of the first collectors, being an inlet collector for the first fluid, comprising at least two connection lines (52, 54, 56, 58), the other (42) of the first collectors, being an outlet collector for the first fluid, comprising at least two other connection lines (60, 62, 64), the punched plates (20) of the first heat exchange block (12) being maintained between the first separation plate (16) and a first end plate (24) longitudinally opposite the first sepration plate (16);

the first end plate (24) carries a first coupling flange (28) for an inlet of refrigerant fluid for condensation and a second coupling flange (30) for an outlet of condensed refrigerant fluid;

a first inlet pipe stub (32), intended for the first fluid, discharging into a connection line, referred to as upstream (52), of the connection lines of the inlet collector for the first fluid, a first outlet pipe stub (34), intended for the first fluid, discharging into a connection line, referred to as downstream (64), of the connection lines of the outlet collector for the first fluid, the connection lines of the inlet collector and the outlet collector for the first fluid being arranged to permit the alternating circulation of the first fluid from the inlet collector (40) towards the outlet collector (42), from the upstream connection line (52) towards the downstream connection line (64), and an outlet line (68) placing the downstream connection line (64) in communication with the first outlet pipe stub (34) in such a way that the first inlet pipe stub (32) and the first outlet pipe stub (34) are provided on the same first end plate (24) of the stacked punch plates and aligned in the same longitudinal plane and the first coupling flange (28) and the second coupling flange (30) are provided on the same first end plate (24) and aligned in the same longitudinal plane.

2. The condenser as claimed in claim 1, comprising two second collectors (44, 46) formed by alignment in the longitudinal direction and the placing in fluid communication of inlet and outlet orifices belonging respectively to the blades intended for the second fluid.

3. The condenser as claimed in claim 2, wherein the first collectors (40, 42) are mutually juxtaposed in the lateral direction and/or the second collectors (44, 46) are mutually juxtaposed in the lateral direction.

4. The condenser as claimed in claim 1, wherein the first inlet pipe stub (32) and/or the first outlet pipe stub (34) pass through the first end surface (24).

5. The condenser as claimed in claim 1, comprising blanking plates (66) for the inlet (39) and/or outlet orifices belonging to the blades intended for the first fluid, each being a blanking plate defining two connection lines in the first respective collector, wherein at least one of the blanking plates (66) is adapted for the purpose of being passed through by the outlet line (68).

6. The condenser as claimed in claim 5, wherein the blanking plate (66) is provided with an orifice having a form corresponding to the cross section of the outlet line (68), at least in the vicinity of the blanking plate, and with a seal arranged externally between the outlet line and the blanking plate.

7. The condenser as claimed in claim 6, wherein the seal comprises a solder deposit.

8. The condenser as claimed in claim 1, wherein the outlet line (68) passes successively through the inlet and/or outlet (39) orifices of each blade forming an adjacent connection line (62) to the downstream connection line (64) in the outlet collector for the first fluid (42).

9. The condenser as claimed in claim 8, wherein the outlet line (68) passes through the inlet and/or outlet orifices of each blade forming each connection line (60, 62) arranged longitudinally between the first end surface (24) and the downstream connection line (64), in the outlet collector for the first fluid (42).

10. The condenser as claimed in claim 2, wherein a first part of the stacked punch plates defines the second blades interleaved in a part of the first blades, whereas a second part of the stacked punch plates defines third blades intended for the circulation of a third fluid, the said third blades being interleaved in the other part of the said first blades, the said downstream connection line (64) belonging to the second part of the stacked punch plates.

11. The condenser as claimed in claim 10, comprising two third collectors (48, 50) mutually juxtaposed in the lateral direction and formed by alignment in the longitudinal direction and the placing in fluid communication of inlet and outlet orifices (39) belonging respectively to the blades intended for the third fluid, the third collectors being defined in their entirety as at least two connection lines (48, 50), a third inlet pipe stub (36) and a third outlet pipe stub (38) intended for the third fluid.

12. The condenser as claimed in claim 10, wherein the third inlet pipe stub (36) and the third outlet pipe stub (38) pass through a second end surface (26) of the stacked punch plates, the second surface (26) being longitudinally opposite the first end surface (24).

13. The condenser as claimed in claim 11, wherein the third inlet pipe stub (36) and the third outlet pipe stub (38) are in fluid communication respectively with the third collectors (48, 50).

14. The condenser as claimed in claim 1, wherein the separation plate (16, 18) comprises a first orifice (72) adapted to be passed through by the outlet line (68).

15. The condenser as claimed in claim 1, wherein the separation plate (16, 18) is adapted to block the inlet and outlet orifices belonging to the blades intended for the second fluid that are remote from the first end surface.

16. The condenser as claimed in claim 1, wherein the separation plate (16, 18) is provided with supplementary orifices (78, 80) calibrated to place the second collectors (44, 46) and the third collectors (48, 50) respectively in fluid communication.

* * * * *